US005207253A

United States Patent [19]

Hoshino et al.

[11] Patent Number: 5,207,253

[45] Date of Patent: May 4, 1993

[54] PLUNGE ROUTER

[75] Inventors: Kiyo Hoshino, Phoenix, Ariz.; Ronald C. McCurry, West Union, S.C.

[73] Assignee: Ryobi Motor Products, Corp, Pickens, S.C.

[21] Appl. No.: 855,836

[22] Filed: Mar. 20, 1992

[51] Int. Cl.[5] ..... B25F 5/00

[52] U.S. Cl. ..... 144/136 C; D8/67; 144/134 D; 144/371; 409/182

[58] Field of Search ..... 409/182; 144/134 R, 144/134 D, 136 R, 136 C, 371; D8/67

[56] References Cited

U.S. PATENT DOCUMENTS

| | | | |
|---|---|---|---|
| D. 281,218 | 11/1985 | Barrett et al. | D8/67 |
| D. 286,131 | 10/1986 | Yamamoto | D8/67 |
| D. 286,132 | 10/1986 | Yamamoto | D8/67 |
| D. 307,104 | 4/1990 | Monobe et al. . | |
| D. 307,104 | 4/1990 | Monobe et al. | D8/67 |
| 3,487,747 | 1/1970 | Burrows et al. | 409/182 |
| 4,102,370 | 7/1978 | Vess | 144/134 D |
| 4,108,225 | 8/1978 | Hestily | 144/134 D |
| 4,239,428 | 12/1980 | Berzina | 409/182 |
| 4,244,406 | 1/1981 | Stielper | 144/136 C |
| 4,316,685 | 2/1982 | George | 409/182 |
| 4,319,860 | 3/1982 | Beares | 409/182 |
| 4,445,811 | 5/1984 | Sanders | 409/182 |
| 4,562,872 | 1/1986 | Fushiya et al. | 144/134 D |
| 4,566,830 | 1/1986 | Maier et al. | 409/182 |
| 4,770,573 | 9/1988 | Monobe | 409/182 |
| 4,921,023 | 5/1990 | Pempek | 144/134 D |
| 4,942,912 | 7/1990 | Gakhar et al. | 144/136 C |

*Primary Examiner*—W. Donald Bray
*Attorney, Agent, or Firm*—Brooks & Kushman

[57] ABSTRACT

A portable electric plunge router (10) having an improved housing (20) including a right handle (28) and a left handle (30) each including an elongated portion (32) and a hand rest lobe portion (34). The handles of the router are conveniently gripped in two positions corresponding to a plunge operation and guided movement position and a detail or free-hand cutting position. In the plunge or guided cutting position, the elongated portion (32) of the handles are gripped. In the detailed or free-hand cutting position, the hand rest lobe portions (34) of the handles (28) and (30) are gripped while steadying the router by sliding a portion of the user's hands along the surface of the workpiece (52). An upper surface (36) of the hand rest lobe portion (34) extends radially outwardly and downwardly from the elongated portion (32) of the handles (28) and (30). A bridging portion (38) encloses wiring to switches disposed on the handles (28) and (30). A power switch (40), a power hold-on switch (42) and a speed control switch (48) are preferably located on the right handle (28). A feed release (44) and lock-down switch (46) are preferably disposed on the left handle (30).

11 Claims, 3 Drawing Sheets

PLUNGE ROUTER

TECHNICAL FIELD

The present invention relates to hand-held plunge routers. More particularly, the invention relates to improved handle structures incorporated as part of the plunge router housing.

BACKGROUND OF INVENTION

Plunge routers are used to remove material from surfaces for decorative and functional purposes. Generally, plunge routers must be more powerful than ordinary routers because the router tool must be able to cut perpendicularly into the surface. High torque loads applied to the portable plunge router must be manually restrained.

Plunge routers having handles are well known in the art. Examples of plunge routers having handles are disclosed in U.S. Pat. Nos. 4,244,406; 4,445,811; 4,770,573; 4,562,872 and Des. 307,104.

Prior designs have handles which are intended to be used with a single-grip orientation. In practice, two operational positions are commonly used including a plunge mode when the tool is driven into the work piece and fine detailing mode of operation where the router is steadied by contacting the workpiece with the hands of the operator holding the handles. In the plunge mode the greatest torque loads are encountered and full grip strength must be applied to the router handles. In the fine detailing mode, less material is removed resulting in lower torque loads, but it is important to be able to control and steady router movement by resting the heel or side of the hand on the workpiece.

One problem encountered by prior plunge routers is that of providing handles which enable the user to operate controls while maintaining a firm grip on the router. Portable routers have control switches for turning the router on and off, speed control, plunge advance and retract and plunger lock. Generally, one or more of the control switches are located on the housing of the router at a point spaced from the router handles. Operating a control having a switch mounted on the housing necessitates reaching with a finger or thumb from the handle to the body of the housing.

While some patents disclose the concept of providing a switch on the handle, no known prior design accommodates all necessary controls on the handle of the portable router. Space limitations and the structure connecting the handles to the housing in prior art devices preclude mounting all of the controls on the handles. Handle supports extending from the housing of the router to the handles have to be strong enough to withstand applied torque loads.

These and other problems encountered by the prior art have been solved by the present invention as summarized below.

DISCLOSURE OF INVENTION

The present invention relates to a portable router which is used to remove material from the surface of a workpiece. The portable router includes a base having a planar work-engaging surface. A plurality of guides are affixed to the base and extend generally perpendicularly away from the work-engaging surface of the base. A housing is mounted on the guides for limited movement along a center axis relative to the base. The motor is received in the housing and includes a shaft which is rotatable about the central axis. A tool chuck is secured to the shaft of the motor.

Right and left handles are secured to the respective sides of the housing. Each handle has an elongated portion which is elongated in the same direction as the central axis. Each handle also has a hand rest lobe portion disposed at the end of each handle closest to the base. The elongated portion of each handle may be gripped above the hand rest lobe portion. This is referred to as a plunge position in which a strong grip may be applied to the handle and downward pressure can be exerted onto the hand rest lobe portion. In a fine detailing position, the hand rest lobe portions are gripped while the heel or side of each hand is permitted to slide over the surface of the workpiece to make detailed cuts.

The hand rest lobe portion preferably extends radially outwardly from the elongated portion of the handle. The hand rest lobe features an upper surface which extends radially outwardly from the elongated portion of the handle and slants towards the base to provide a gradual transition between the elongated portion and the hand rest lobe portion.

According to another aspect of the invention, a portable electric plunge router is provided in which an electric motor is received in a housing which includes a base having a work-engaging surface and means for controlling the operation of the router. A pair of elongated handles are disposed at spaced locations on the housing with a bridging portion connecting each of the handles to the housing across a substantial portion of the length of the handles. Hand rest lobe portions are formed on the end of each handle closest to the base of the housing. The hand rest lobes extend outwardly away from an elongated portion of the handles with a gradual transition between the hand rest lobes and the elongated portion of the handles. A plurality of control switches are disposed on the handles with wiring for electrically connecting the control switches to the means for controlling the operation of the router extending through the bridging portions.

Examples of control switches which may be advantageously located on the handles may include a power switch, a power hold-on switch, a feed release switch, a lock-down switch and a speed control switch.

It is an object of the invention to provide a portable router having improved handles which facilitate control of the router while either plunging the tool into the workpiece or guiding the router while making fine detailed cuts.

It is another object of the invention to provide such router wherein switches are conveniently located on the handles to provide finger-tip control while maintaining a secure hold on the router handles.

Another object of the invention is to provide an pair of handles for a plunge router wherein a radially extending lobe is provided against which downward pressure may be exerted upon plunging the router into the workpiece.

Another object of the invention is to provide a hand rest lobe which may be gripped to hold the router while steadying one's hand on the surface to be cut in a detail cutting mode.

These and other advantages and objects of the invention will be better understood upon review of the attached drawings taken in light of the following detailed description of a preferred embodiment of the invention.

DETAILED DESCRIPTION OF DRAWING

BEST MODE FOR CARRYING OUT INVENTION

Figure 1:
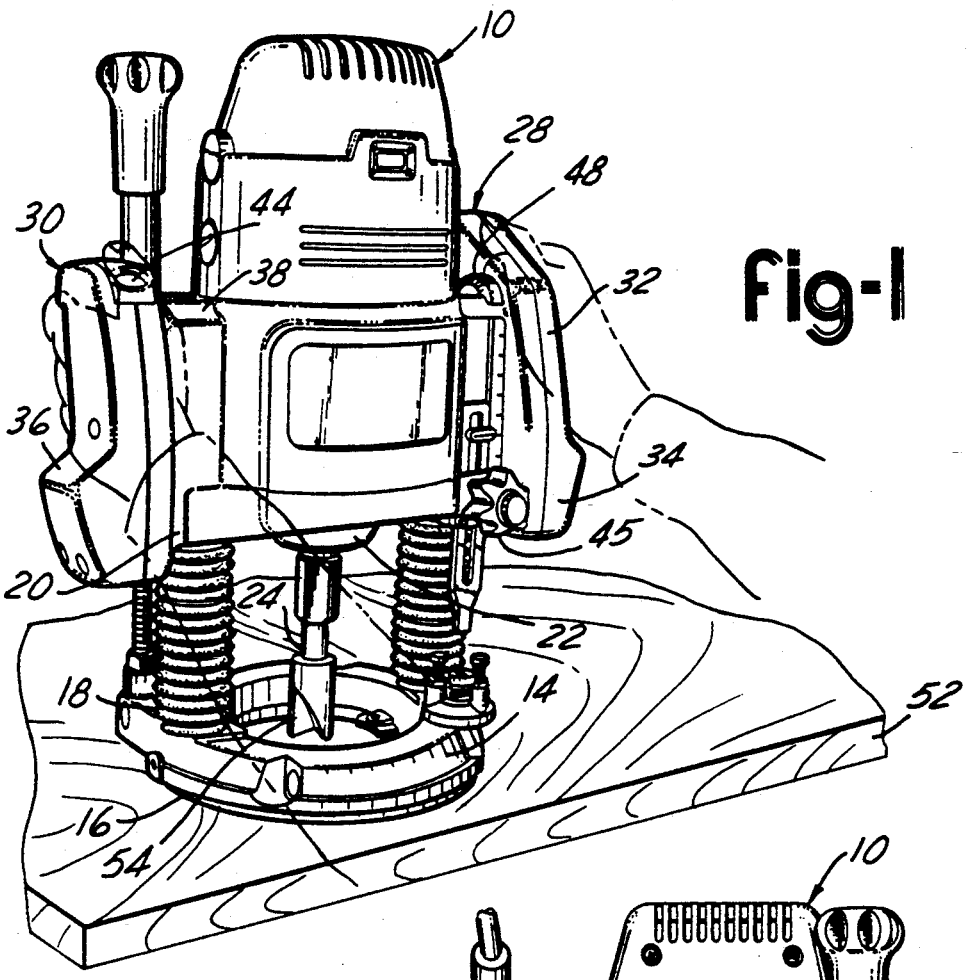
FIG. 1 is a perspective view of a portable electric plunge router made in accordance with the present invention.

Referring now to FIG. 1, the portable electric plunge router 10 of the present invention is shown. The plunge router 10 includes a base 14 having a work-engaging surface 16. The base 14 is connected by guides 18 to the housing 20 for the motor 22 of the plunge router 10. A shaft 24 is driven by the motor 22.

A right handle 28 and a left handle 30 are attached to the housing 20 at spaced locations. The unique configuration of the right and left handles 28 and 30 will be described in greater detail below. Each handle has an elongated portion 32 disposed above a hand rest lobe portion 34. References to upper and lower relative locations are intended to refer to the normal orientation of the router 10 wherein the router is operated on top of a horizontal surface. It should be understood that the router can also be used on vertical surfaces, inclined surfaces or inverted surfaces. The elongated portion 32 is located above the hand rest portion 34. An upper surface 36 of the hand rest lobe portion 34 extends radially outwardly and downwardly from the elongated portion 32. The upper surface 36 forms a transition slope wherein a user's hands may be moved from the elongated portion 32 by sliding along the length of the elongated portion 32 to the hand rest lobe portion 34 while maintaining a firm grip on the handles 28 and 30. A bridging portion 38 extends between each of the right and left handles 28 and 30.

Electrical wires are routed between the right and left handles 28 and 30 to the housing 20 through the bridging portions 38. The bridging portion extends substantially the entire vertical length of the right and left handles 28 and 30 to securely connect the handles 28 and 30 to the housing 20.

Figure 2:
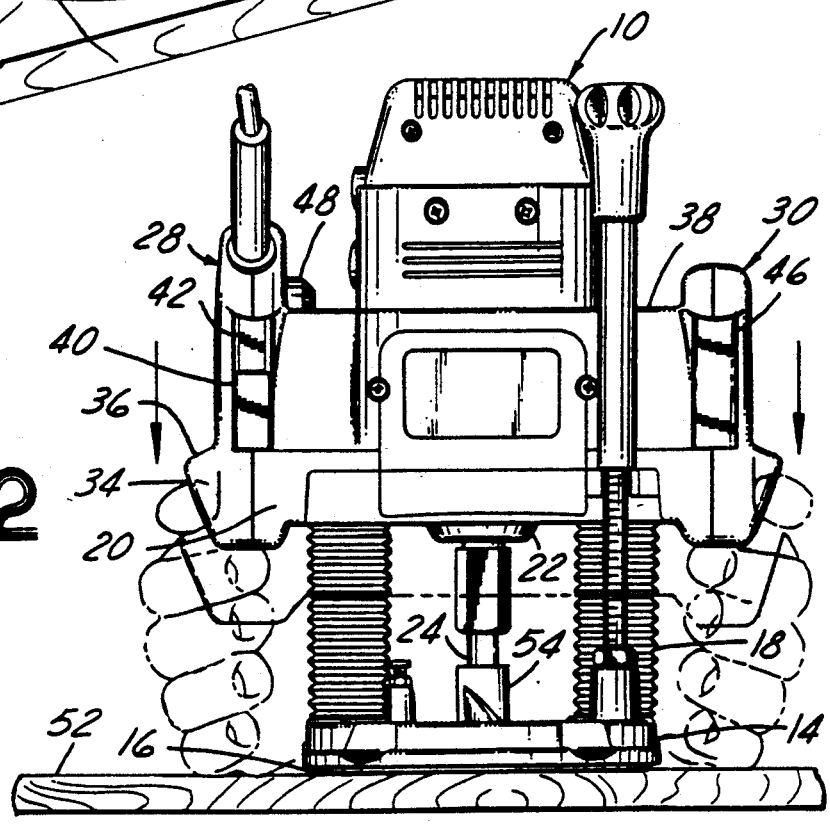
FIG. 2 is a front elevation view of a portable electric plunge router of the present invention on a workpiece being held in detail cutting position.
Figure 3:
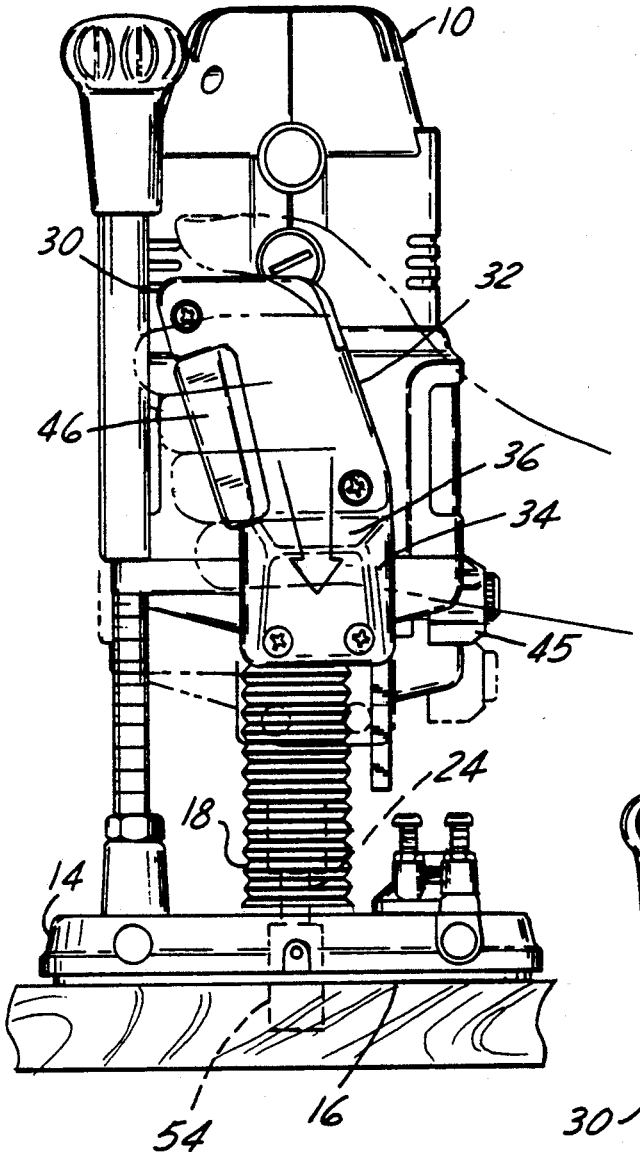
FIG. 3 is a left side elevation view of the portable electric plunge router of the present invention being held in the plunge position.
Figure 5:
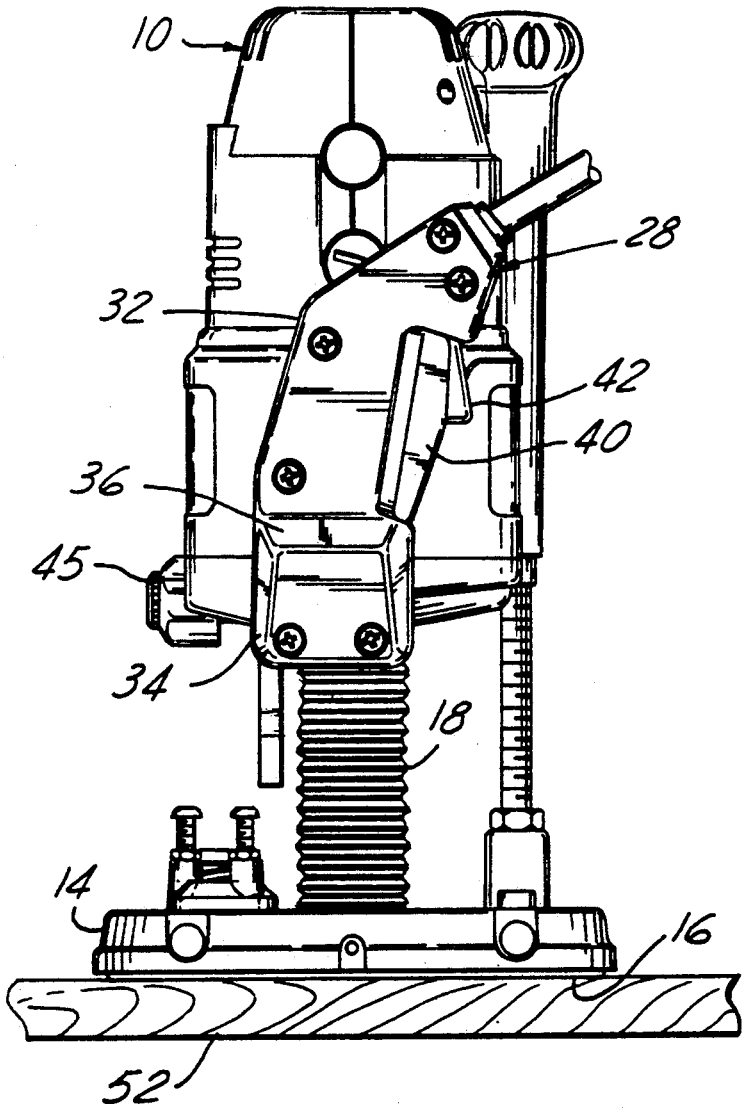
FIG. 5 is a right side elevation view of a portable electric plunge router made in accordance with the present invention.

Referring now to FIGS. 2, 3, and 5 the portable electric plunge router 10 of the present invention is shown in different cutting positions. Base 14 having work-engaging surface 16 is connected by the guides 18 to the housing 20. A motor 22 disposed within the housing 20 drives the shaft 24. Right and left handles having a elongated portions 32 and a hand rest lobe portion 34 are also illustrated. The angular orientation of the upper surface 36 of the lobe portion 34 is shown in FIGS. 2, 3, and 5 as it extends from the elongated portion 32 to the hand rest lobe portion 34. Bridging portions 38 interconnect right and left handles 28 and 30 to the housing 20.

A power switch 40 for turning the plunge router 10 on and off is provided on the right handle 28. A power hold-on switch 42 overlays the power switch 40 and enables the user to lock the power switch 40 in its on position.

On top of the left handle 30, as best seen in FIG. 1, a feed release switch 44 is provided. The feed release 44 allows the housing 20 to move toward the base 14. The feed release switch 44 is conveniently located so that when the user grips the elongated portions 32 of the right and left handles 28 and 30 pressure can be applied to the upper surface 36 of the hand rest lobe portion 34.

Feed depth is controlled by a depth-of-cut gauge 45, as best shown in FIG. 1. Operation of the feed mechanism is described in my co-pending application Ser. No. 779,074, the disclosure of which is hereby incorporated by reference. A lock-down switch 46 is shown on left handle 30. The lock-down switch 46 is engaged to lock the plunge router 10 at the desired cutting depth. The lock-down switch 46 is elongated and extends substantially the length of the elongated portion 32 of the left handle 30 and can be accessed even when the hand rest lobe portion 34 of the left handle 30 is gripped. A speed control dial 48 is disposed adjacent to the right handle 28. The speed control dial 48 is used to control the speed at which the motor 22 operates.

Figure 4:
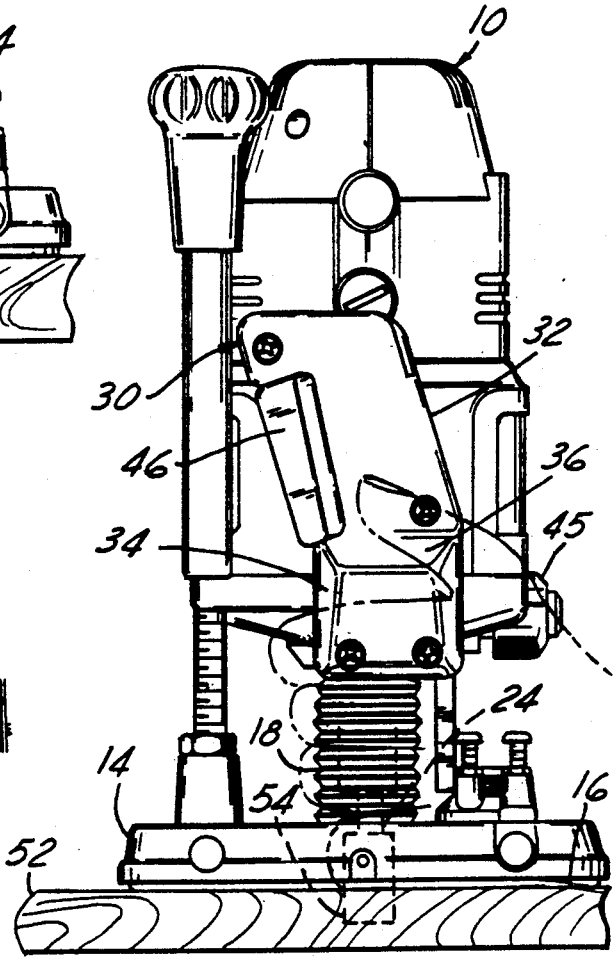
FIG. 4 is a left side elevation view of a portable electric plunge router of the present invention shown being held in the detail cutting position.

Referring now to FIG. 4, the router 10 is shown in its detail or free-hand position. Normally, the router is initially held as shown in FIG. 3 with the tool 54 is plunged into the workpiece 52. When it is desirable to cut free-hand or detailed grooves the operator's hands may be shifted downwardly on the handles until the hand rest lobe portions 34 of the right and left handles 28 and 30 are gripped. The router 10 has already been plunged into the workpiece 52 and the power hold-on switch 42 is engaged as well as the lock-down switch 46. The hand rest lobe portions 34 provide a convenient gripping point for the user's hands while the user's hands are permitted to slide over the surface of the workpiece 52. The ability to hold the plunge router 10 securely while sliding along the surface of the workpiece 52 allows the router to be steadied during detail or free-hand cuts.

The above detailed description of the claimed invention is intended to enable one of ordinary skill in the art to practice the invention. While one embodiment has been disclosed, other modifications are possible. The preceding description should be read in an illustrative sense. The scope of the invention should be interpreted by reference to the following claims.

I claim:

1. A portable plunge router for cutting a workpiece comprising:

a base having a planar work engaging surface;

a plurality of guides affixed to the base and extending generally perpendicularly away from the work engaging surface of the base;

a housing mounted on said guides for limited movement along a central axis towards and away from the base;

a motor having a shaft rotatable about the central axis, the motor being disposed in the housing;

a tool chuck secured to the shaft of the motor; and a right and left handles secured to right and left sides of the housing, respectively, each handle having an elongated portion which is elongated in the direction of the central axis and a hand rest lobe portion disposed at the end of each handle closest to the base, wherein the elongated portion of each handle is a first hand grip grippable by a hand above the hand rest lobe portion in a plunge position with the hand resting on top of the hand rest lobe portion, and wherein each hand rest lobe portion is a second hand grip grippable by the hand while another portion of the same hand is enabled to slide on the workpiece in a detail cut position.

2. The portable router of claim 1 wherein the hand rest lobe portion extends radially outward from the elongated portion of the handle.

3. The portable router of claim 1 wherein the hand rest lobe has an upper surface extending radially outwardly from the elongated portion and slanting toward the base to provide a gradual transition between the elongated portion and the hand rest lobe portion.

4. A portable electric router comprising:

an electric motor;

housing means for receiving said motor, said housing means including a base having a work engaging surface and having means for controlling operation of the router;

a pair of elongated handles disposed at spaced locations on the housing;

a bridging portion connecting each of said handles to said housing means across a substantial portion of the length of the handles;

hand rest lobe portions formed on an end of each handle closest to the base of the housing means, the hand rest lobes extending outwardly away from an elongated portion of the handles with a gradual transition between the hand rest lobes and the elongated portion of the handles; and a plurality of control switches disposed on said handles;

means extending through said bridging portions for electrically connecting said control switches to the means for controlling operation of the router.

5. The portable electric router of claim 4 wherein the control switches disposed on the handles comprise a power switch, a power hold on switch, a feed release switch, a lock down switch and a speed control switch.

6. The portable electric router of claim 4 wherein the control switches disposed on one of the handles comprise a power switch and a power hold on switch, and the control switches disposed on the other of the handles comprise a feed release switch and a lock down switch.

7. The invention as defined in claim 4 wherein at least one of said plurality of switches is a lock down switch on at least one of said elongated handles.

8. The invention as defined in claim 4 wherein at least one of said plurality of switches is elongated for access by a hand at said at least one elongated handle and access by a hand at said respective hand rest lobe.

9. The invention as defined in claim 1 and further comprising at least one control switch on at least one of said elongated handles.

10. The invention as defined in claim 9 wherein said control switch is elongated for access by a hand at said first hand grip and access by a hand at said second hand grip.

11. The invention as defined in claim 10 wherein said control switch is a lock down switch.

* * * * *